US005553773A

United States Patent [19]

Focke et al.

[11] Patent Number: 5,553,773

[45] Date of Patent: Sep. 10, 1996

[54] HINGE-LID BOX FOR CIGARETTES OR THE LIKE

[75] Inventors: Heinz Focke, Verden; Hans-Jürgen Bretthauer, Bremen, both of Germany

[73] Assignee: Focke & Co. (GmbH & Co.), Verden, Germany

[21] Appl. No.: 413,461

[22] Filed: Mar. 28, 1995

[30] Foreign Application Priority Data

Mar. 30, 1994 [DE] Germany ..... 44 10 803.6

[51] Int. Cl.[6] ..... B65D 17/32

[52] U.S. Cl. ..... 229/224; 206/273; 229/160.1; 229/930

[58] Field of Search ..... 229/160.1, 930, 229/221, 224, 230, 231, 146, 152; 206/268, 273

[56] References Cited

U.S. PATENT DOCUMENTS

| | | | |
|---|---|---|---|
| 2,998,910 | 9/1961 | Gillam | 229/160.1 |
| 3,099,382 | 7/1963 | Talbert | 229/160.1 |
| 3,438,564 | 4/1969 | Moreton | 229/160.1 |
| 5,024,376 | 6/1991 | Focke | 229/160.1 |
| 5,203,495 | 4/1993 | Jorgensen-Beck et al. | 229/160.1 |
| 5,465,836 | 11/1995 | Focke | 206/273 X |

FOREIGN PATENT DOCUMENTS

| | | | |
|---|---|---|---|
| 1250553 | 2/1989 | Canada . | |
| 530651 | 10/1993 | European Pat. Off. . | |
| 3713612 | 11/1988 | Germany | 229/160.1 |

*Primary Examiner*—Allan N. Shoap
*Assistant Examiner*—Christopher J. McDonald
*Attorney, Agent, or Firm*—Sughrue, Mion, Zinn, Macpeak & Seas

[57] ABSTRACT

Hinge-lid box for cigarettes or the like, with box part (12) and lid (13).

For the material-saving and simpler manufacture of hinge-lid boxes, a collar (38) is connected integrally, via material webs (43, 44, 45), to a main blank (33) for the hinge-lid box. The resulting overall blank is folded in a conventional manner, the material webs (43, 44, 45) effecting a connection of the lid (10) to the box part (12) in the region of the lid front wall (20). When the hinge-lid box is opened for the first time, the material webs (43, 44, 45) are broken.

2 Claims, 3 Drawing Sheets

HINGE-LID BOX FOR CIGARETTES OR THE LIKE

BACKGROUND OF THE INVENTION

The invention relates to a hinge-lid box for cigarettes or the like, comprising a box part and a lid connected pivotably thereto, and a collar which is anchored in the box part and, by means of a sub-region, projects out of the same. The invention further relates to a blank for producing hinge-lid boxes.

The use of hinge-lid boxes as packaging for cigarettes is widespread. The standard design of a hinge-lid box comprises a box part and a lid. The latter is connected pivotably, in the region of a lid rear wall, to a box rear wall. Positioned in the box part is a collar which comprises collar front wall and collar side tabs. The collar anchored in the box part projects out of the box part by means of a sub-region which, in the closed position of the lid, is enclosed by said lid.

The hinge-lid box comprises a conventionally single-piece blank of thin cardboard. The collar is usually a separate blank, likewise of thin cardboard.

For cost-effective and material-saving manufacture of hinge-lid boxes of this type, it is advantageous if the collar is connected integrally to the blank for the hinge-lid box. Proposals of various types are known for this purpose.

SUMMARY OF THE INVENTION

The object of the invention is to propose a hinge-lid box which can be produced in a cost-effective and material-saving manner and which, furthermore, is protected against undesired opening before being used.

In order to achieve this object, the hinge-box according to the invention is-characterized in that the lid is connected to the collar by (thin) material webs or residual connections, which can be severed when the lid is opened for the first time.

The material webs or residual connections preferably consist of the same packaging material as the blank, that is to say of thin cardboard, and provide a connection between the blank for the hinge-lid box and the collar, this resulting in an overall single-piece blank.

For material-saving configuration of the hinge-lid box or of the single-piece blank for the hinge-lid box, the collar is connected to the blank of the hinge-lid box, via material webs, in the region of a lid inner tab fastened on the inner side of a lid front wall. The lid inner tab, which is conventional in hinge-lid boxes, is shaped such that, when the blank is in the non-folded, flat state, a depression or clearance formed in the region of the collar front wall is filled appropriately, in a positively locking manner, by the correspondingly configured lid inner tab. A plurality of, in particular three, material webs connect the collar to the lid inner tab in the region of the collar front wall.

Further features of the invention relate to the configuration of the hinge-lid box or of the blank in the region of the lid, on the one hand, and of the collar, on the other hand. An exemplary embodiment of the invention is explained in more detail hereinbelow with reference to the drawings, in which:

DESCRIPTION OF PREFERRED EMBODIMENTS

Figure 1:
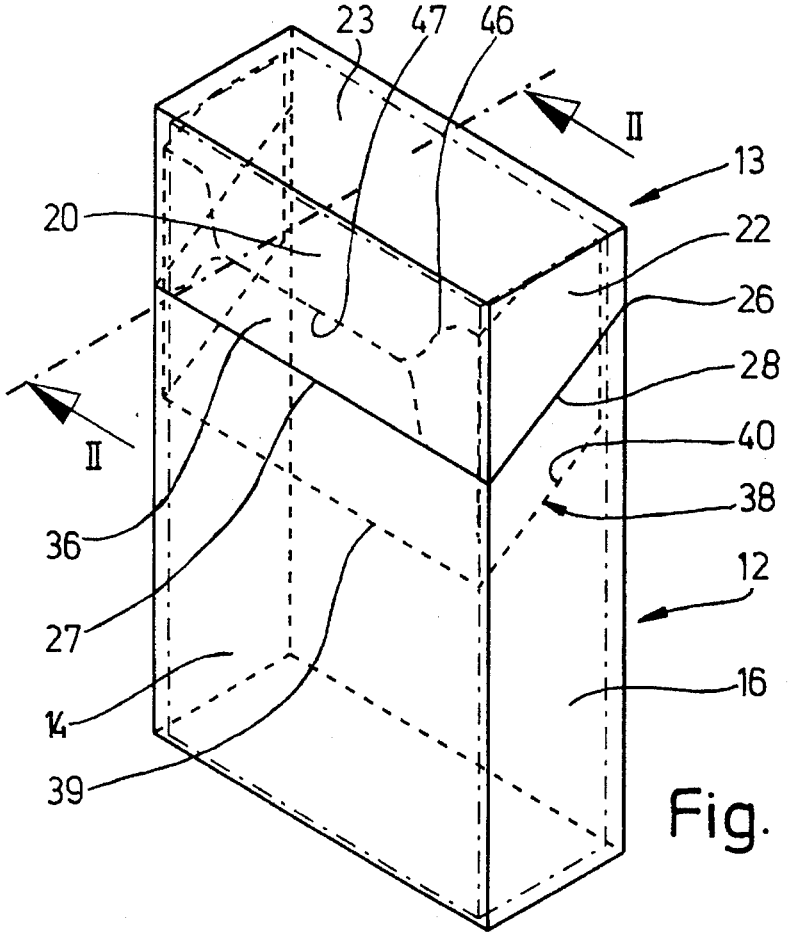
FIG. 1 shows a perspective representation of a closed hinge-lid box.

The exemplary embodiments in the drawings relate to a hinge-lid box for cigarettes 10. A cigarette group 11 is wrapped in an inner blank of paper or tin foil, and thus forms, as cigarette block, the contents of the pack.

The hinge-lid box shown comprises—as do conventional packs of this type—a box part 12 and a lid 13. The box part 12 forms a box front wall 14, a box rear wall 15, narrow box side walls 16 and a base wall 17. The box side walls 16 are formed from mutually overlapping box side tabs 18 and 19 which are connected to one another by adhesive bonding. Analogously thereto, the lid 13 comprises a lid front wall 20, a lid rear wall 21, lid side walls 22 and an upper end wall 23. The lid side walls 22 comprise mutually overlapping lid side tabs 24 and 25 which are adhesively bonded to one another. Box part 12 and lid 13 are connected pivotably to one another, in the region of box rear wall 15 and lid rear wall 21, along an articulation line 26.

In the closed position, box part 12 and lid 13 butt against one another, in the region of the front walls, along a transversely directed abutment edge 27 and, in the region of the side walls, along an obliquely upwardly directed abutment edge 28. The latter results from oblique edges 29 and 30 of the box side tabs 18, 19, on the one hand, and corresponding oblique edges 31, 32 of the lid side tabs 24, 25, on the other hand.

The abovedescribed parts form a main blank 33 for the hinge-lid box. This includes base corner tab 34 and lid corner tab 35. Furthermore, a lid inner tab 36 usually belongs to a main blank 33 of this type. Said lid inner tab 36 adjoins the free side or a free closure edge 37 of the lid front wall 20. When the hinge-lid box is in the finished state, the lid inner tab 36 is folded over against the inner side of the lid front wall 20 and is connected thereto, in particular by adhesive bonding.

A further constituent part of a hinge-lid box is a collar 38. The latter comprises a collar front wall 39 and collar side tabs 40 and 41. When the hinge-lid box is in the finished state, the collar 38 is seated with a lower region in the box part 12 and is fixed here on the inner side of the box front wall 14 and/or on the box side walls 16 by adhesive bonding. That region of the collar 38 which projects out of the box part 12 is enclosed by the lid 13 when the box is in the closed position. Collar front wall 39, on the one hand, and collar side tabs 40, 41, on the other hand, are separated off from one another by folding edges or folding lines 42.

The collar 38 forms an integral unit with the main blank of the hinge-lid box. For this purpose, the collar 39 is connected to the main blank 33 by material webs 43, 44, 45. The material webs 43 . . . 45 are thin residual connections of the packaging material, having a width of approximately 1 mm. The material webs 43 . . . 45 are formed, by corresponding punching, in the region between main blank 33 and collar 38, namely by partial punching between the material webs 43 . . . 45.

In the case of the present exemplary embodiment, the material webs 43 . . . 45 are formed in the region of the collar front wall 39, on the one hand, and of the lid inner tab 36, on the other hand. This thus produces a connection between an upper, transversely directed collar edge 46 of the collar front wall 39 and a free, transversely directed border 47 of the lid inner tab 36, which runs parallel to the collar edge 46.

A further special feature consists in the fact that the main blank 33 adjoins the collar 38 in the material-saving and positively locking manner. The collar front wall 39 is provided with a depression 48 which is conventional in hinge-lid boxes. The correspondingly configured lid inner tab 36 fits into said depression 48. Accordingly, said lid inner tab 36 is of a somewhat smaller width than the lid front wall 20. The border 47 is designed in an arcuate manner on the sides. The size and shape of the lid inner tab 36 corresponds to the depression 48.

The design of the overall blank in the region of the collar side tabs 40, 41, on the one hand, and of the lid side tabs 24, on the other hand, is also important. The collar side tabs 40, 41 are provided, in a subregion, with an oblique edge 49, which is adapted to the oblique edge 31 of the lid side tabs. This is adjoined by a transverse edge 50, which is formed by punching a triangular cutout 51 out of the overall blank. Opposite the angled-off edges 50, 31, the collar side tabs 40, 41 are bounded by a side edge 52 which is directed obliquely and runs parallel to the oblique edges 49.

Specific geometrical interrelations are to be taken into account for the configuration and dimensions of the collar 38, on the one hand, and of the lid inner tab 36, on the other hand. A distance 53 between a folding edge 54 of the lid front wall 20 with respect to the end wall 23 and the transverse edge 50 of the collar side tabs 40, 41 should not be less than double the width 55 of the lid inner tab 36. The following rule thus applies: (53)≧2·(55). These dimensions are to be maintained because the transverse edge 50, as upper boundary of the collar 38, can be received without constraint within the lid 13 in the closed position and during opening and closing.

This configuration of the collar 38 permits, on the one hand, material-saving positioning of the blanks within a web of material or a sheet of material. The oblique edges 29 of the box side tabs 19 of a blank adjoin the side edges 52 of the collar 38 of an adjacent blank in an appropriately fitting manner. Accordingly, there is only a very small amount of material waste, due to the cutouts 51.

Furthermore, the configuration of the blank for the finished hinge-lid box is important. The upper edge of the collar side tabs 40, 41 is angled off. This ensures easy opening and closing of the lid 13. The horizontally running transverse edge 50 determines the upper, reliable boundary of the collar 38, with abutment against the end wall 23 and/or the folded-in lid corner tabs 35.

Figure 2:
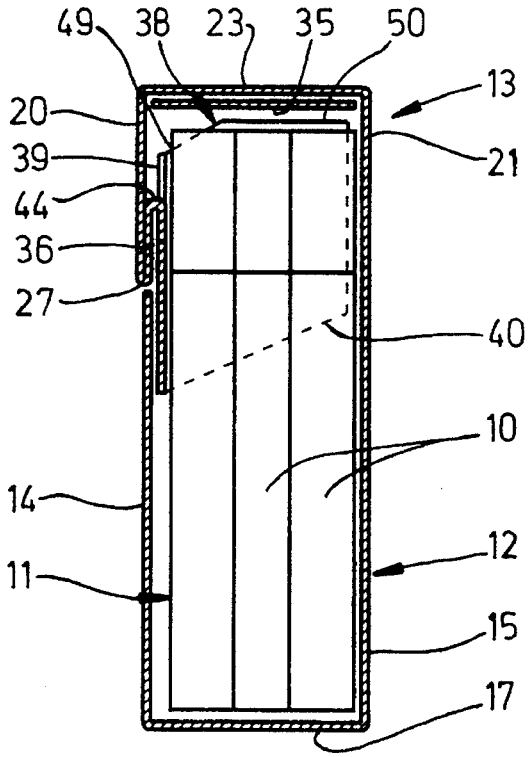
FIG. 2 shows a vertical section through the hinge-lid box according to FIG. 1, along section plane II—II.
Figure 3:
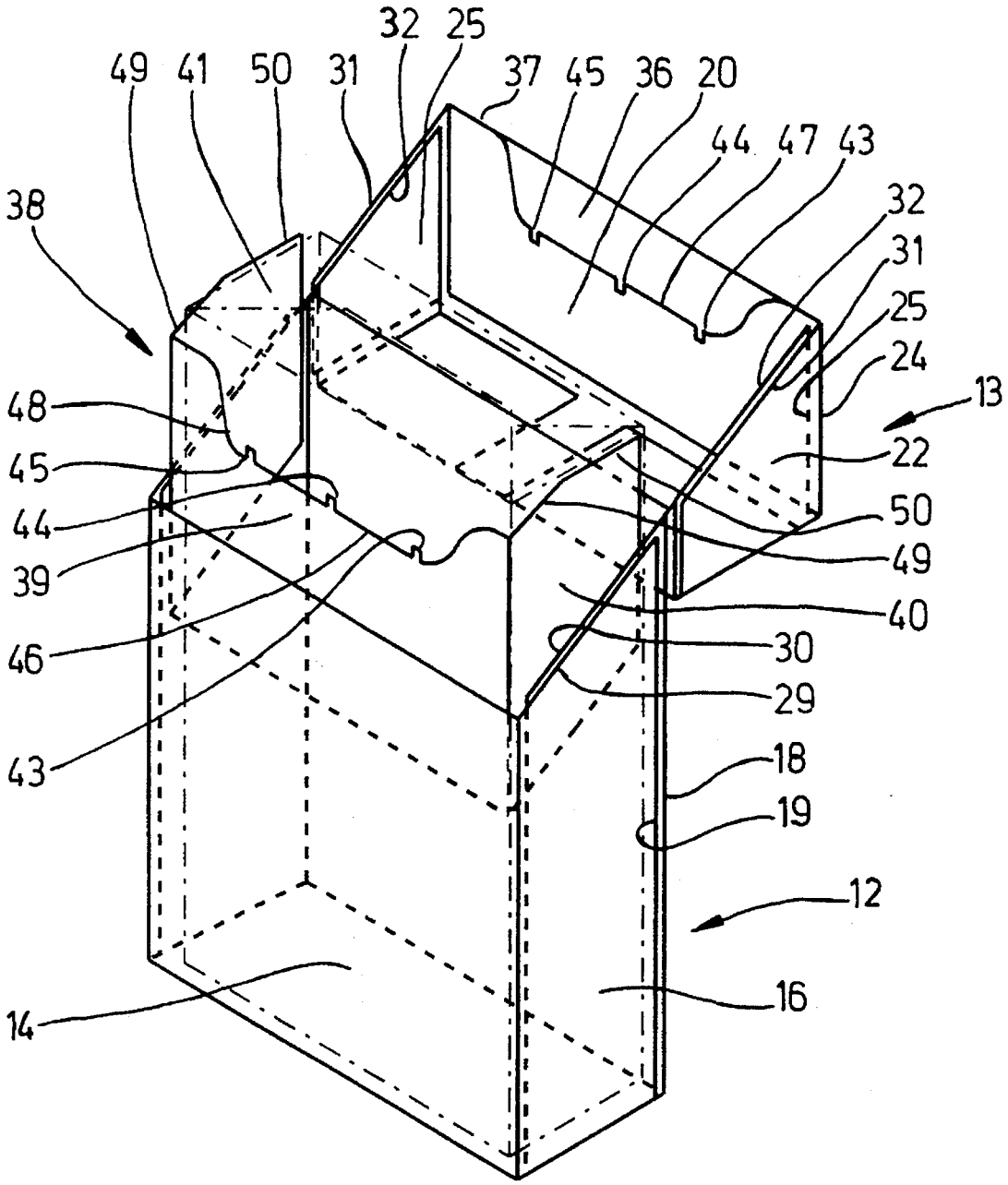
FIG. 3 shows the hinge-lid box according to FIG. 1 in the open position.
Figure 4:
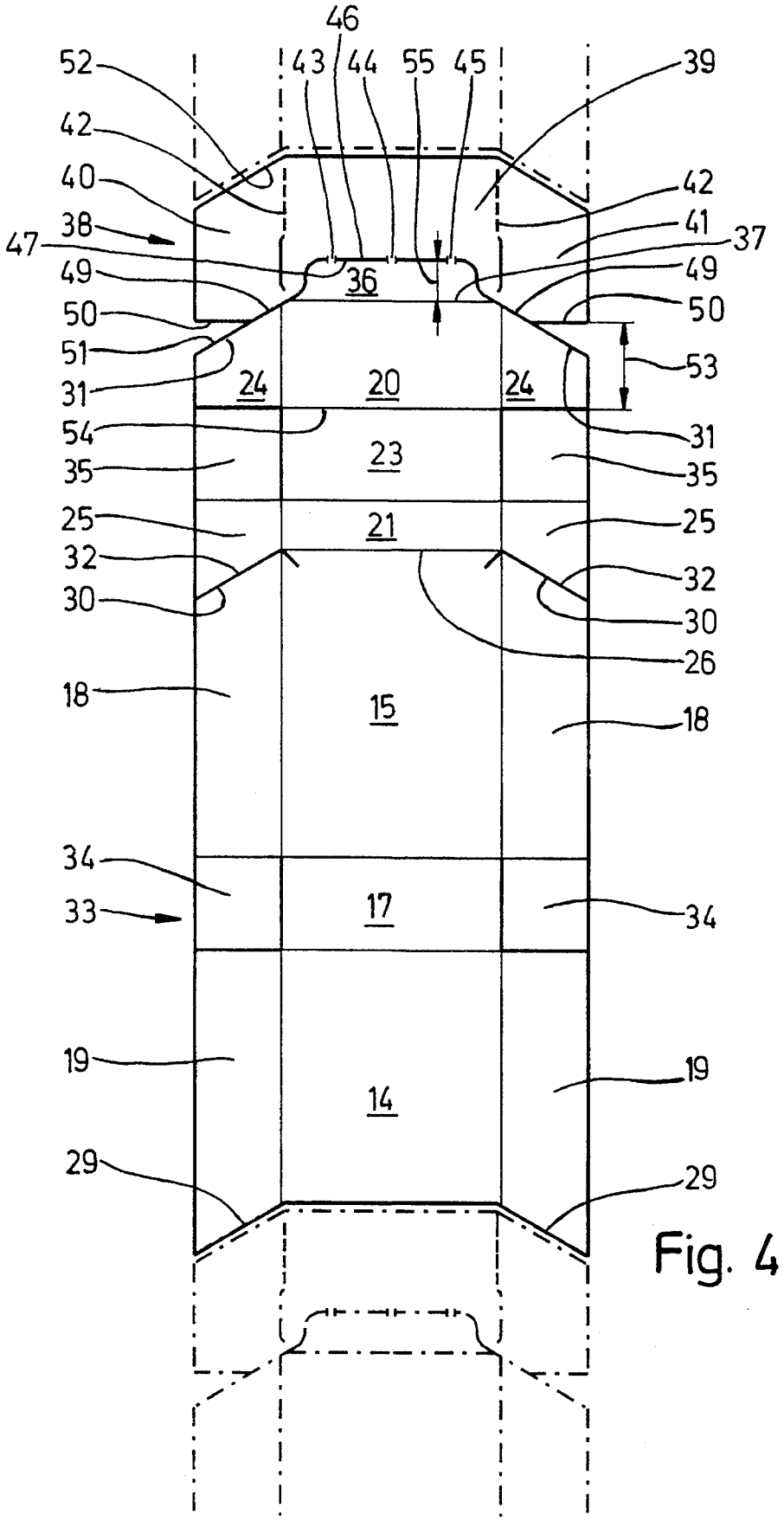
FIG. 4 shows a spread-out blank for a hinge-lid box according to FIG. 1 to FIG. 3.

The blank according to FIG. 4 can be processed favourably from a manufacturing standpoint. In order to bring the collar 38, which is connected to the main blank 33 via the material webs 43, 44, 45, into the appropriate position for the pack, in accordance with FIG. 2, folding along two transversely directed, parallel folding lines is required. Firstly, the lid inner tab 36 is to be folded along the closure edge 37 or the folding line defined by the same—the collar 38 being taken along in the process. The latter is then folded over in the opposite direction in the region of the collar edge 46 and of the border 47 of the lid inner tab 36. This thus results, overall, in Z-shaped folding (FIG. 2). It is thus important that the material webs 43, 44, 45 are all located in this folding line and extend transversely thereto. Any number of material webs 43, 44, 45 can thus be selected.

First-time opening of the hinge-lid pack, which is reliably retained in the closed position by material webs 43, 44, 45, can be effected in a simple manner by pivoting back the lid 13 and the resulting severing of the material webs 43, 44, 45.

What is claimed is:

1. A hinge-lid cigarette box comprising a box part (12), a lid (13) pivotably connected to said box part, and a collar (38) which is anchored in the box part (12) and which has a sub-region that projects out of the box part, wherein:

a) in a region of a from wall (20) of the lid, the lid (13) is connected to a front wall (39) of the collar by a plurality of thin material webs (43, 44, 45) which are severable in response to a first opening of the lid (13) from a closed position thereof;

b) the lid has an inner tab (36) which is fitted on the lid from wall (20) and is fastened to an inner side thereof, and the collar front wall (39) is connected to the lid inner tab (36) by the material webs (43, 44, 45);

c) the lid inner tab (36) has a shape and size that corresponds to that of a depression (48) in the collar from wall (39);

d) the depression (48) is located in a central region of the collar from wall (39) which has a transversely directed collar edge (46), and the lid inner tab (36) has a transversely directed border (47) which extends parallel to the collar edge (46); and e) in a region of the depression (48), said plurality of material webs (43, 44, 45) are located only on the transversely directed collar edge (46) and the transversely directed border (47) of the lid inner tab (36).

2. A blank for producing hinge-lid boxes for cigarettes (10), comprising a main blank (33) for forming a box part (12) and a lid (13), and further comprising a collar (38) which is connected to the main blank (33) only via a plurality of material webs (43, 44, 45) and which has a collar front wall (39) and collar side tabs (40, 41), the material webs being located in a region of a lid inner tab (36) of the main blank (33) and in a depression (48) of the from wall (39), wherein:

a) the depression (48) is located in a central region of the collar front wall (39) which has a transversely directed collar edge (46), and the lid inner tab (36) has a transversely directed border (47) which extends parallel to the collar edge (46);

b) in a region of the depression (48), the plurality of material webs (43, 44, 45) are only in the transversely directed collar edge (46) and the transversely directed border (47) of the lid inner tab (46);

c) for forming lid side walls (22), the lid has side tabs (24, 25) having free oblique edges (31) which are fitted on the lid front wall (20);

d) the collar has side tabs (40, 41) that also have oblique edges (49) which correspond to the oblique edges (31) of the lid side tabs (24, 25), and which butt against the oblique edges (31) of the lid side tabs (24, 25);

e) the collar side tabs (40, 41) have transverse edges (50) which adjoin the oblique edges (49) of the collar side tabs (40, 41) at an upper boundary of the collar side tabs (40, 41) when the hinge-lid box is in a finished state; and f) a folding edge (54), formed at a juncture of the lid front wall (20) and an end wall (23) of the lid, is spaced from each of the transverse edges (50) of the collar side tabs (40, 41) by a distance equal to at least twice a width (55) of the lid inner tab (36).

* * * * *